US011236921B2

(12) United States Patent
Shen et al.

(10) Patent No.: US 11,236,921 B2
(45) Date of Patent: Feb. 1, 2022

(54) METHOD FOR CONTROLLING WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Wenjun Shen, Foshan (CN); Zhigang Xing, Foshan (CN); Hui Yu, Foshan (CN); Yuhang Tang, Foshan (CN); Kangwen Zhang, Foshan (CN); Zhisheng Lei, Foshan (CN); Yu Liu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 347 days.

(21) Appl. No.: 16/498,244

(22) PCT Filed: Jul. 26, 2019

(86) PCT No.: PCT/CN2019/098022
§ 371 (c)(1),
(2) Date: Sep. 26, 2019

(87) PCT Pub. No.: WO2020/232828
PCT Pub. Date: Nov. 26, 2020

(65) Prior Publication Data

US 2021/0404686 A1 Dec. 30, 2021

(30) Foreign Application Priority Data

May 22, 2019 (CN) ..... 201910428242.3

(51) Int. Cl.
*F24F 11/49* (2018.01)
*F24F 11/64* (2018.01)
(Continued)

(52) U.S. Cl.
CPC ..... *F24F 11/49* (2018.01); *F24F 11/64* (2018.01); *F24F 11/86* (2018.01); *F24F 11/871* (2018.01);
(Continued)

(58) Field of Classification Search
CPC .. F24F 11/49; F24F 11/64; F24F 11/86; F24F 11/871; F24F 2110/10; F24F 2110/12;
(Continued)

(56) References Cited

U.S. PATENT DOCUMENTS 10,612,804 B2 * 4/2020 Brahme ..... F24F 11/56
2010/0205989 A1 * 8/2010 Creed ..... F25B 49/025 62/228.5

FOREIGN PATENT DOCUMENTS

CN 101788179 A 7/2010
CN 105716203 A 6/2016
(Continued)

OTHER PUBLICATIONS

World Intellectual Property Organization (WIPO) Written Opinion for PCT/CN2019/098022 dated Feb. 26, 2020 10 Pages.
(Continued)

*Primary Examiner* — Marc E Norman
(74) *Attorney, Agent, or Firm* — Anova Law Group PLLC

(57) ABSTRACT

A method for controlling an air conditioner includes, after the air conditioner is turned on, controlling an indoor ambient temperature sensor, an indoor heat exchanger temperature sensor, an outdoor heat exchanger temperature sensor, an outdoor ambient temperature sensor, and an
(Continued)

exhaust gas temperature sensor to determine an indoor ambient temperature, an indoor heat exchanger temperature, an outdoor heat exchanger temperature, an outdoor ambient temperature, and an exhaust gas temperature, respectively, determining a first, second, third, fourth, and fifth compressor frequencies based on the indoor ambient temperature, the indoor heat exchanger temperature, the outdoor heat exchanger temperature, the outdoor ambient temperature, and the exhaust gas temperature, respectively, determining a minimum compressor frequency based on the first, second, third, fourth, and fifth compressor frequencies, and controlling a compressor of the air conditioner to operate at the minimum compressor frequency.

20 Claims, 7 Drawing Sheets

(51) Int. Cl.

| | |
|---|---|
| ***F24F 11/86*** | (2018.01) |
| ***F24F 11/871*** | (2018.01) |
| *F24F 140/20* | (2018.01) |
| *F24F 110/10* | (2018.01) |

(52) U.S. Cl.
CPC ..... *F24F 2110/10* (2018.01); *F24F 2140/20* (2018.01)

(58) Field of Classification Search
CPC ..... F24F 2140/20; F25B 2600/025; F25B 2700/2116; F25B 2700/2117; F25B 2700/21152; F25B 2700/2106
See application file for complete search history.

(56) References Cited

FOREIGN PATENT DOCUMENTS

| | | | |
|---|---|---|---|
| CN | 106080096 | A | 11/2016 |
| CN | 107178873 | A | 9/2017 |
| CN | 108444078 | A | 8/2018 |
| JP | 2006090567 | A | 4/2006 |
| JP | 2010210198 | A | 9/2010 |
| JP | 2015021656 | A | 2/2015 |
| KR | 20050011565 | A | 1/2005 |

OTHER PUBLICATIONS

The State Intellectual Property Office of PRC (SIPO) The First Office Action for CN Application No. 201910428242.3 dated Jul. 1, 2020 16 Pages (Translation Included ).

World Intellectual Property Organization (WIPO) International Search Report for PCT/CN2019/098022 dated Feb. 26, 2020 19 Pages.

* cited by examiner

METHOD FOR CONTROLLING WINDOW AIR CONDITIONER

CROSS-REFERENCE TO RELATED APPLICATIONS

This application is a National Stage Entry under 35 U.S.C. § 371 of International Application No. PCT/CN2019/098022, filed on Jul. 26, 2019, which is based on and claims priority to Chinese Patent Application Serial No. 201910428242.3, filed on May 22, 2019, the entire contents of both which are incorporated herein by reference.

FIELD

The present disclosure relates to a field of air conditioning technology, and particularly, to a method for controlling a window air conditioner.

BACKGROUND

In the related art, a window air conditioner adopts a fixed speed compressor with simple logic control, and reveals some obvious defects. First, the speed of the fixed speed compressor is invariable, so when the indoor environment reaches a set temperature, the indoor ambient temperature can only be controlled by a stop-operation-stop continuous cycle. Second, when the outdoor ambient temperature is relatively high, the fixed speed compressor is likely to shut down due to the excessive temperature of the compressor, and it generally takes a long time for the compressor to recover from the shutdown to restart, thereby resulting in poor user comfort experience. Thus, how to ensure reliable operation of the compressor and improve user comfort are technical problems that need to be solved by those skilled in the art.

SUMMARY

The present disclosure aims to at least solve one of the technical problems existing in the related art. To this end, the present disclosure provides a method for controlling a window air conditioner, which is advantageous in improving operational reliability of a compressor.

In the method for controlling the window air conditioner according to embodiments of the present disclosure, the window air conditioner includes a compressor, an outdoor heat exchanger, an outdoor fan, an indoor heat exchanger, an indoor fan, an indoor ambient temperature sensor configured to detect an indoor ambient temperature T1, an indoor heat exchanger temperature sensor configured to detect a temperature T2 of the indoor heat exchanger, an outdoor heat exchanger temperature sensor configured to detect a temperature T3 of the outdoor heat exchanger, an outdoor ambient temperature sensor configured to detect an outdoor ambient temperature T4, and an exhaust gas temperature sensor configured to detect an exhaust gas temperature TP. The method includes: controlling the indoor ambient temperature sensor, the indoor heat exchanger temperature sensor, the outdoor heat exchanger temperature sensor, the outdoor ambient temperature sensor, and the exhaust gas temperature sensor to carry out detection, after the window air conditioner is turned on; obtaining a corresponding first compressor frequency based on the detected indoor ambient temperature T1, obtaining a corresponding second compressor frequency based on the detected temperature T2, obtaining a corresponding third compressor frequency based on the detected temperature T3, obtaining a corresponding fourth compressor frequency based on the detected outdoor ambient temperature T4, obtaining a corresponding fifth compressor frequency based on the detected exhaust gas temperature TP, and comparing the first compressor frequency, the second compressor frequency, the third compressor frequency, the fourth compressor frequency, and the fifth compressor frequency to acquire a minimum compressor frequency; and controlling the compressor to operate at the minimum compressor frequency.

With the method for controlling the window air conditioner according to the embodiments of the present disclosure, by comparing the first compressor frequency, the second compressor frequency, the third compressor frequency, the fourth compressor frequency, and the fifth compressor frequency to acquire the minimum compressor frequency, and by controlling the compressor to operate at the minimum compressor frequency, when the outdoor ambient temperature reaches a preset temperature, the compressor operates at the minimum compressor frequency to avoid the shutdown of the compressor; when the outdoor ambient temperature is too high, it is beneficial in preventing the compressor from being shut down due to excessive temperature, thereby allowing the compressor to operate reliably, and guaranteeing the cooling or heating performance of the window air conditioner, so as to ensure the user comfort experience.

In some embodiments of the present disclosure, when one of the indoor ambient temperature sensor, the indoor heat exchanger temperature sensor, the outdoor heat exchanger temperature sensor, the outdoor ambient temperature sensor, and the exhaust gas temperature sensor is faulty, the faulty sensor is controlled to obtain a corresponding compressor frequency according to a corresponding setting condition.

In some embodiments of the present disclosure, when two or more of the indoor ambient temperature sensor, the indoor heat exchanger temperature sensor, the outdoor heat exchanger temperature sensor, the outdoor ambient temperature sensor, and the exhaust gas temperature sensor are faulty, the window air conditioner is controlled to stop operating.

In some embodiments of the present disclosure, when the indoor ambient temperature sensor is faulty, the indoor ambient temperature T1 detected by the indoor ambient temperature sensor is set to 26° C.

In some embodiments of the present disclosure, a first temperature interval, a second temperature interval, a third temperature interval, and a fourth temperature interval are set. In a case that the indoor heat exchanger temperature sensor is faulty, during refrigeration, when the indoor ambient temperature T1 is detected to be in the first temperature interval, the second compressor frequency is a first set value, and when the indoor ambient temperature T1 is detected to be in the second temperature interval, the second compressor frequency is a second set value, temperatures in the first temperature interval being lower than those in the second temperature interval; during heating, when the detected indoor ambient temperature T1 is in the third temperature interval, the second compressor frequency is the second set value, and when the detected indoor ambient temperature T1 is in the fourth temperature interval, the second compressor frequency is the first set value, temperatures in the third temperature interval being lower than those in the fourth temperature interval.

In some embodiments of the present disclosure, a plurality of indoor temperature intervals are preset, and the plurality of indoor temperature intervals correspond to different first compressor frequencies; an indoor temperature interval which a difference between the indoor ambient temperature T1 and a set temperature belongs to is determined to obtain the corresponding first compressor frequency.

In some embodiments of the present disclosure, when it is determined that the detected temperature T2 of the indoor heat exchanger is lower than a first set temperature, an operating frequency of the compressor is reduced at predetermined time intervals, until the temperature T2 is in the fifth temperature interval.

In some embodiments of the present disclosure, the compressor is turned off when it is detected that the temperature T2≤0° C.

In some embodiments of the present disclosure, when it is detected that the temperature T3 of the outdoor heat exchanger is greater than a first preset temperature, the outdoor fan is controlled to be turned on, and when it is detected that the temperature T3 of the outdoor heat exchanger is lower than a second preset temperature, the outdoor fan is controlled to be turned off, wherein the second preset temperature is lower than the first preset temperature.

In some embodiments of the present disclosure, a refrigerant used in the window air conditioner is refrigerant R32.

In some embodiments of the present disclosure, a sixth compressor frequency is obtained according to a wind level of the indoor fan, and the first compressor frequency, the second compressor frequency, the third compressor frequency, the fourth compressor frequency, the fifth compressor frequency, and the sixth compressor frequency are compared to acquire the minimum compressor frequency.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference the accompanying drawings, in which.

Figure 1:
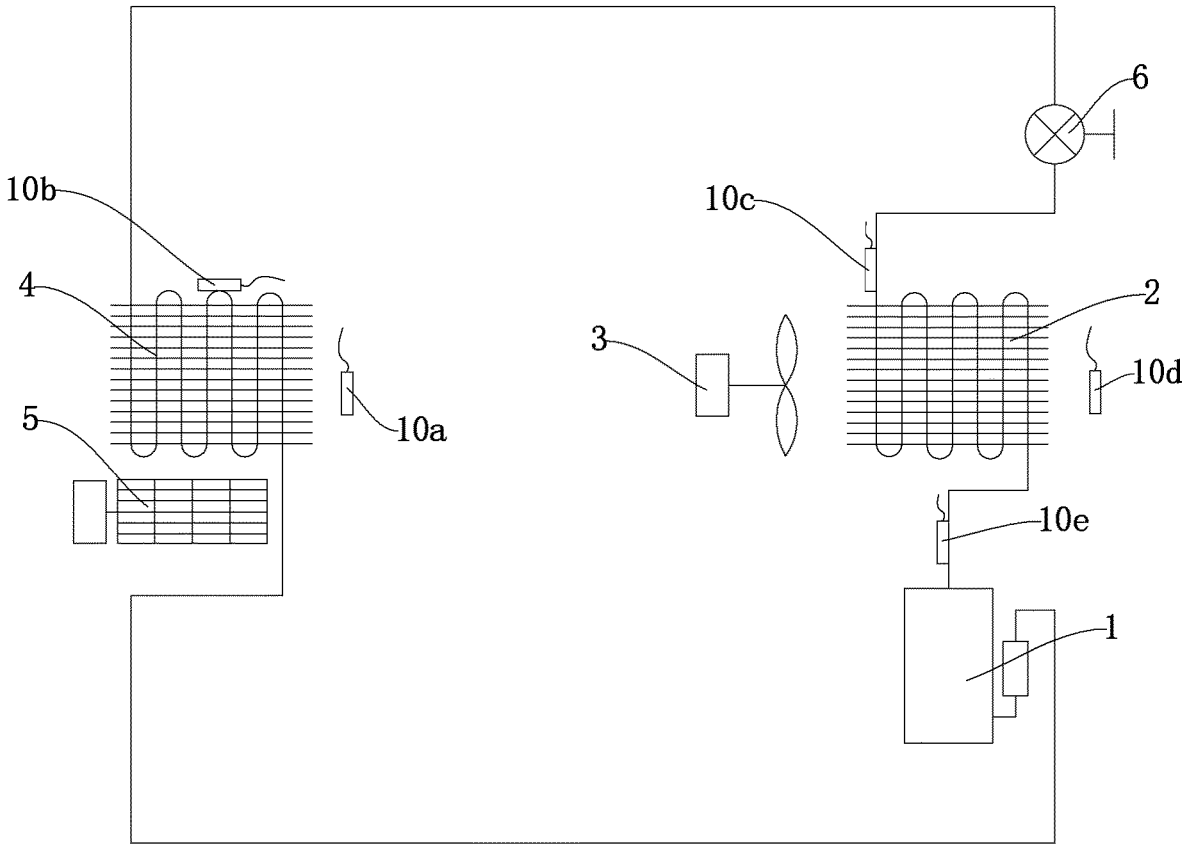
FIG. 1 is a structural schematic view of a window air conditioner according to some embodiments of the present disclosure.

REFERENCE NUMERALS window air conditioner 100, compressor 1, outdoor heat exchanger 2, outdoor fan 3, indoor heat exchanger 4, indoor fan 5, throttling device 6, processing pipe 7, indoor ambient temperature sensor 10*a*, indoor heat exchanger temperature sensor 10*b*, outdoor heat exchanger temperature sensor 10*c*, outdoor ambient temperature sensor 10*d*, exhaust gas temperature sensor 10*e*.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

The following description provides many different embodiments or examples for implementing different structures of the present disclosure. In order to simplify the description, components and settings of specific examples are described below. Certainly, they are merely examples and are not intended to limit the present disclosure. In addition, the present disclosure may repeat reference numerals and/or letters in different examples. This repetition is for the purpose of simplicity and clarity, and does not indicate the relationship of various embodiments and/or settings discussed. Moreover, the present disclosure provides examples of various specific processes and materials, but those skilled in the art may recognize the applicability of other processes and/or the use of other materials.

A method for controlling a window air conditioner 100 according to embodiments of the present disclosure will be described below with reference to the drawings.

As shown in FIG. 1, in the method for controlling the window air conditioner 100 according to the embodiments of the present disclosure, the window air conditioner 100 can include a compressor 1, an outdoor heat exchanger 2, an outdoor fan 3, an indoor heat exchanger 4, an indoor fan. 5, an indoor ambient temperature sensor 10*a*, an indoor heat exchanger temperature sensor 10*b*, an outdoor heat exchanger temperature sensor 10*c*, an outdoor ambient temperature sensor 10*d*, and an exhaust gas temperature sensor 10*e*.

The window air conditioner 100 further includes a throttling device 6. A refrigerant circulation flow path can be defined among the compressor 1, the outdoor heat exchanger 2, the throttling device 6, and the indoor heat exchanger 4. The compressor 1 can drive a refrigerant to circulate in the refrigerant circulation flow path. The outdoor fan 3 drives an outdoor air flow to the outdoor heat exchanger 2 to improve the heat exchange capacity of the outdoor heat exchanger 2, and the indoor fan 5 drives an indoor air flow to the indoor heat exchanger 4. The indoor heat exchanger 4 exchanges heat with the indoor 4 air flow to regulate the indoor environment. For instance, in some examples, the compressor 1 is an inverter compressor, and the indoor fan 5 is a cross flow fan or a centrifugal fan.

As shown in FIG. 1, the indoor ambient temperature sensor 10*a* is used to detect an indoor ambient temperature T1; the indoor heat exchanger temperature sensor 10*b* is used to detect a temperature T2 of the indoor heat exchanger 4; the outdoor heat exchanger temperature sensor 10*c* is used to detect a temperature T3 of the outdoor heat exchanger 2; the outdoor ambient temperature sensor 10*d* is used to detect an outdoor ambient temperature T4; and the exhaust gas temperature sensor 10*e* is used to detect an exhaust gas temperature TP of the compressor 1.

The control method includes: controlling the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* to carry out detection after the window air conditioner 100 is turned on. It could be understood that the indoor ambient temperature sensor 10*a*, the indoor heat exchanger temperature sensor 10*b*, the outdoor heat exchanger temperature sensor 10*c*, the outdoor ambient temperature sensor 10*d*, the exhaust gas temperature sensor 10*e*, and the compressor all conduct signal transmission with an electronic control device of the window air conditioner 100.

A corresponding first compressor frequency is obtained according to the detected indoor ambient temperature T1; a corresponding second compressor frequency is obtained according to the detected temperature T2; a corresponding third compressor frequency is obtained according to the detected temperature T3; a corresponding fourth compressor frequency is obtained according to the detected outdoor ambient temperature T4; a corresponding fifth compressor frequency is obtained according to the detected exhaust gas temperature TP. The first compressor frequency, the second compressor frequency, the third compressor frequency, the fourth compressor frequency, and the fifth compressor frequency are compared to acquire a minimum compressor frequency, and the compressor 1 is controlled to operate at the minimum compressor frequency.

It could be understood that an operating frequency of the compressor 1 is determined by the indoor ambient temperature T1, the temperature T2, the temperature T3, the outdoor ambient temperature T4, and the exhaust gas temperature TP. After receiving electrical signals of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e*, the electronic control device can obtain the first compressor frequency, the second compressor frequency, the third compressor frequency, the fourth compressor frequency, and the fifth compressor frequency, and use the minimum compressor frequency acquired by comparing the first compressor frequency, the second compressor frequency, the third compressor frequency, the fourth compressor frequency and the fifth compressor frequency as the operating frequency of the compressor 1.

Thus, the combination of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* can reliably guarantee the reliable operation of the window air conditioner 100. When the outdoor ambient temperature reaches a preset temperature, the compressor 1 operates at the minimum compressor frequency, which can avoid shutdown of the compressor 1. When the outdoor ambient temperature is too high, it is beneficial in preventing the compressor 1 from being shut down due to excessive temperature, thereby allowing the compressor 1 to operate reliably, and guaranteeing the cooling or heating performance of the window air conditioner 100, so as to ensure user comfort experience.

In the method for controlling the window air conditioner 100 according to the embodiments of the present disclosure, by comparing the first compressor frequency, the second compressor frequency, the third compressor frequency, the fourth compressor frequency, and the fifth compressor frequency to acquire the minimum compressor frequency, and by controlling the compressor 1 to operate at the minimum compressor frequency, when the outdoor ambient temperature reaches the preset temperature, the compressor 1 operates at the minimum compressor frequency, avoiding the shutdown of the compressor, and when the outdoor ambient temperature is too high, it is beneficial in preventing the compressor 1 from being shut down due to excessive temperature, thereby allowing the compressor 1 to operate reliably, and guaranteeing the cooling or heating performance of the window air conditioner 100, so as to ensure the user comfort experience.

In some examples of the present disclosure, the window air conditioner 100 is a cooling-and-heating-type air conditioner, and the window air conditioner 100 further includes a four-way valve. The compressor 1 has a suction port and an exhaust port, and the suction port of the compressor 1, the exhaust port of the compressor 1, one end of the outdoor heat exchanger 2, and one end of the indoor heat exchanger 4 are connected by a four-way valve. The throttling device 6 is connected in series between the other end of the indoor heat exchanger 4 and the other end of the outdoor heat exchanger 2, thereby defining a refrigerant circulation flow path. The compressor 1 can drive the refrigerant to circulate in the refrigerant circulation flow path. The outdoor fan 3 drives the air flow to the indoor heat exchanger 4 to improve efficiency of heat exchange between the outdoor heat exchanger 2 and the outdoor environment. The indoor fan 5 drives the indoor air flow to the indoor heat exchanger 4, and the refrigerant in the indoor heat exchanger 4 exchanges heat with the indoor air to adjust the temperature of the indoor environment.

In some examples, the throttling device 6 may be a device having a throttling function, such as a capillary tube, an electronic expansion valve, a restriction orifice plate, a throttle valve or the like, and the throttling device 6 can be used to throttle a high-temperature and high-pressure refrigerant into a low-temperature and low-pressure refrigerant.

In some examples, after the window air conditioner 100 is powered on, it is first checked whether a DC bus voltage is under voltage. If the DC bus voltage is under voltage, the window air conditioner 100 does not operate until the DC bus voltage is greater than a certain value for more than 2 seconds, and then a main relay is closed, such that the window air conditioner 100 restarts operation. Within 10 seconds before the voltage returns to normal, loads such as the outdoor fan 3 and the indoor fan 5 cannot be turned on, and can only be turned on after 10 seconds, to prevent frequent close of the main relay due to voltage fluctuations. If the DC bus voltage is not under voltage, the main relay is closed, and it is checked whether all the temperature sensors are normal; if they are all normal, a maximum frequency at which the compressor 1 can operate is controlled according to a cooling mode, a dehumidification mode, an automatic mode, a heating mode, and a value of T4 detected by the outdoor ambient temperature sensor 10*d*.

In some examples, the outdoor ambient temperature sensor 10*d* is disposed adjacent to the outdoor heat exchanger 2 and is not in contact with the outdoor heat exchanger 2, so as to measure the outdoor ambient temperature T4, which is related to the heat exchange capacity of the outdoor heat exchanger 2. For example, in the control logic of the electronic control device, the outdoor ambient temperature T4 is divided into N temperature intervals, and each temperature interval corresponds to a maximum frequency at which the compressor 1 can operate, that is, each temperature interval corresponds to a preset value of the fourth compressor frequency, wherein the compressor 1 is an inverter compressor. The outdoor ambient temperature sensor 10*d* detects the temperature of the outdoor environment, and the electronic control device can determine whether the current outdoor ambient temperature T4 is constantly rising or constantly dropping, or is slightly changing within a certain defined temperature interval, based on a measurement result of the outdoor ambient temperature sensor 10*d*. Based on the outdoor ambient temperature T4, the operating frequency of the inverter compressor 1 is limited to the maximum frequency at which the compressor 1 can operate within the temperature interval.

Figure 3:
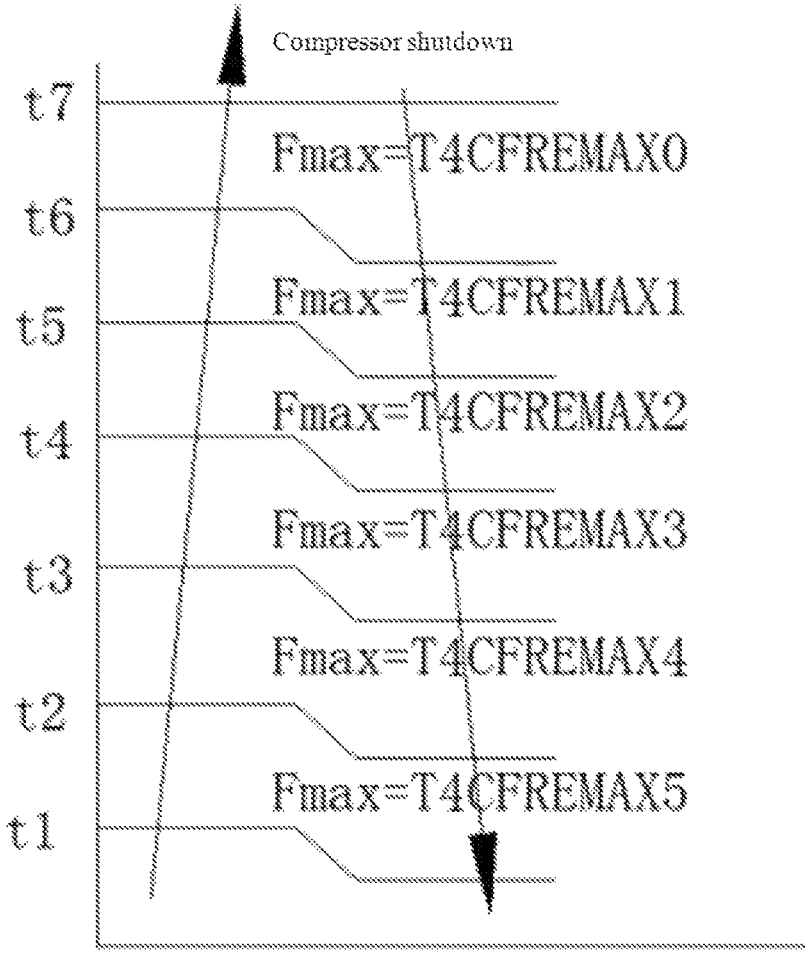
FIG. 3 is a schematic view showing temperature interval division for temperature T4 according to embodiments of the present disclosure.

For example, as shown in FIG. 3, an oblique upward arrow in the figure indicates the rise of the outdoor ambient temperature T4, while an oblique downward arrow in the figure indicates the drop of the outdoor ambient temperature. The figure only indicates temperature values of the temperature intervals when the outdoor ambient temperature T4 rises, and the temperature intervals have their respective temperature values when the outdoor ambient temperature drops, but they are not illustrated. During the rise of the outdoor ambient temperature T4, when the value of T4 is greater than t7, the compressor 1 is stopped; when t6<T4<t7, a maximum target frequency of the compressor 1 is T4CFREMAX0, that is, the fourth compressor frequency is T4CFREMAX0; when t5<T4<t6, the maximum target frequency of the compressor 1 is T4CFREMAX1, that is, the fourth compressor frequency is T4CFREMAX1; when t4<T4<t5, the maximum target frequency of the compressor 1 is T4CFREMAX2, that is, the fourth compressor frequency is T4CFREMAX2; when t3<T4<t4, the maximum target frequency of the compressor 1 is T4CFREMAX3, that is, the fourth compressor frequency is T4CFREMAX3; when t2<T4<t3, the maximum target frequency of the compressor 1 is T4CFREMAX4, that is, the fourth compressor frequency is T4CFREMAX4; when t1<T4<t2, the maximum target frequency of the compressor 1 is T4CFREMAX5, that is, the fourth compressor frequency is T4CFREMAX5. In some examples, the compressor 1 begins to rise to the maximum target frequency T4CFREMAX0 from a minimum operating frequency, and the minimum operating frequency is generally not lower than a lower limit of an operating frequency range in which the compressor 1 can operate.

During operation of the compressor 1, the electronic control device continuously detects the values detected by the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e*. When the ambient temperature rises, the frequency of the compressor 1 is increased to the maximum frequency value corresponding to the temperature interval. For example, when the outdoor ambient temperature sensor 10*d* detects that t2<T4<t3, the maximum target frequency of the compressor 1 is T4CFREMAX5, that is, when t2<T4<t3, the frequency of the compressor 1 can rise to T4CFREMAX5; when the outdoor ambient temperature drops, the maximum target frequency of the compressor 1 also falls to a maximum target value of the temperature interval where T4 is located. It should be noted that the target maximum value is not necessarily the actual operating frequency of the compressor 1, that is, the fourth compressor frequency is not necessarily the actual operating frequency of the compressor 1. During the operation of the compressor 1, the actual operating frequency may also be subject to the exhaust gas temperature TP, the electric current of the compressor 1, a wind level of the indoor fan 5, the indoor ambient temperature T1, a set temperature of the window air conditioner 100 set by the user, the temperature T2 of the indoor heat exchanger 4, and the temperature T3 of the outdoor heat exchanger 2.

In some examples, according to a detection result of the outdoor ambient temperature sensor 10*d*, the outdoor ambient temperature can also be divided into N1 intervals, so as to control a rotational speed of the outdoor fan 3. When the outdoor ambient temperature T4 is high, due to a relatively small temperature difference for heat exchange, the heat exchange performance of the outdoor heat exchanger 2 is poor, and the rotational speed of the outdoor fan 3 is relatively high. When the outdoor ambient temperature T4 is lower, the heat exchange performance of the outdoor heat exchanger 2 is relatively better, and the rotational speed of the outdoor fan 3 is relatively low. On the premise of ensuring the energy efficiency of the window air conditioner 100, the power of an outdoor motor can be reduced, which is advantageous in reducing the operating cost of the window air conditioner 100.

In some embodiments of the present disclosure, when it is detected that the temperature T3 of the outdoor heat exchanger 2 is greater than a first preset temperature, the outdoor fan 3 is controlled to be turned on; when it is detected that the temperature T3 of the outdoor heat exchanger 2 is lower than a second preset temperature, the outdoor fan 3 is controlled to be turned off, in which the second preset temperature is lower than the first preset temperature. Therefore, the turn-on and turn-off of the outdoor fan 3 can ensure that the refrigerant in the refrigerant circulation flow path has a certain pressure, so as to keep the refrigerant passing through the throttling device 6, i.e., having a certain refrigeration capacity, which is beneficial in ensuring the reliable operation of the window air conditioner 100, thereby improving the user experience.

In some examples, when the outdoor ambient temperature T4 is lower than a preset value (for example, lower than 15° C.), the logic decides to enter a low-temperature cooling function. When it is determined that the whole machine is in a low-temperature cooling state, if the temperature T3 is greater than a first preset temperature (for example, 10° C.), the outdoor fan 3 is turned on; if the value of the temperature T3 is smaller than a second preset temperature (for example, 7° C.), the outdoor fan 3 is turned off. When the temperature T3 is between the first preset temperature and the second preset temperature, it is required to judge a change trend of T3. When T3 gradually rises from an original temperature lower than the second preset temperature to the first preset temperature, the outdoor fan 3 is kept in an off state, and the outdoor fan 3 is not turned on until T3 is greater than the second preset temperature. When T3 gradually drops from a temperature greater than the second preset temperature to the first preset temperature, the outdoor fan 3 is in an on state, and the outdoor fan 3 is not switched to an off state until T3 is lower than the second preset temperature.

It could be understood that when the window air conditioner 100 is in the low-temperature cooling mode, the turn-on and turn-off of the outdoor fan 3 can ensure that the refrigerant in the refrigerant circulation flow path has a certain pressure, so as to keep the refrigerant passing through the throttling device 6, i.e., having a certain refrigeration capacity. In some examples, when T4>15° C. and T3≥38° C., and this situation lasts one minute, the low-temperature cooling function is exited.

In some examples, as shown in FIG. 1, the exhaust gas temperature sensor 10*e* can be disposed at an exhaust pipe of the compressor 1, and the exhaust gas temperature sensor 10*e* primarily functions to protect the compressor 1.

In some examples, the exhaust gas temperature of the compressor 1 can be divided into four intervals by three temperature points ta, tc, and te, wherein ta<tc<te. That is, an interval where TP is lower than ta is a normal operation interval; an interval from ta to tc is an interval where the compressor frequency keeps constant; an interval from tc to te is a limited frequency interval; and an interval where TP is greater than te is an interval in which the compressor 1 is stopped.

It could be understood that when TP is lower than ta, the compressor 1 operates in a normal mode; when ta<TP<tc, the compressor 1 guarantees to operate at the current frequency; when tc<TP<te, the frequency of the compressor 1 is reduced till TP satisfies: TP<tc, and for example, during the frequency reduction process, the compressor 1 can reduce its frequency once every T minutes; when TP is greater than te and this situation lasts 5 seconds, the compressor 1 is stopped, and the compressor 1 will not be restarted until the exhaust gas temperature TP is below 90° C.

Figure 4:
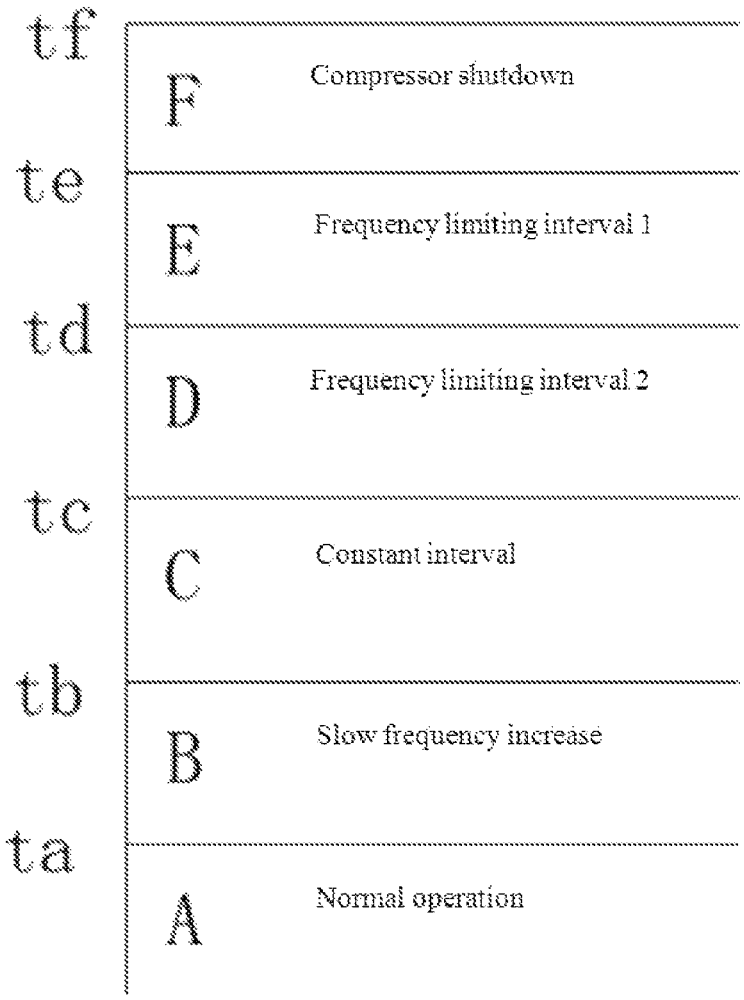
FIG. 4 is a schematic view showing temperature interval division for temperature TP according to embodiments of the present disclosure.

Specifically, in order to further precisely control the operating frequency of the compressor 1 to improve the user comfort, as shown in FIG. 4, the exhaust gas temperature of the compressor 1 can be divided into seven intervals by six temperature points ta, tb, tc, td, te, and tf, in which ta<tb<tc<td<te<tf. When TP is lower than ta, that is, TP is in interval A as illustrated, the compressor 1 operates in the normal mode. When ta<TP<tb, that is, TP is in interval B as illustrated, the compressor 1 enters a slow frequency-increasing interval, and the frequency of the compressor 1 is increased at a speed of TpLimUpSpd_B (for example, this value can be set to 0.04 HZ/S). When tb<TP<tc, that is, TP is in interval C as illustrated, the compressor 1 guarantees to operate at the current frequency. When tc<TP<td, that is, TP is in interval D as illustrated, the frequency of the compressor 1 is reduced at a speed of TpLimDownSpd_D. When td<TP<te, that is, TP is in interval E as illustrated, the frequency of the compressor 1 is reduced at a speed of TpLimDownSpd_E. When te<TP<tf, that is, TP is in interval F as illustrated and lasts for 9 seconds, the compressor 1 is stopped and will not be restarted until the exhaust gas temperature is lower than or equal to 90° C., and moreover in the above 9 seconds, the frequency of the compressor 1 is reduced at a speed of TpLimDownSpd_E.

TpLimUpSpd_B, TpLimDownSpd_D, and TpLimDownSpd_E are preset values, and the value of TpLimDownSpd_D can be greater than TpLimDownSpd_E. It should be noted that during the turn-on of 30 seconds, the compressor 1 is not subject to the frequency limit due to the high exhaust gas temperature, the frequency maintenance, and the slow frequency increase. The number of the temperature intervals divided for TP can be adjusted according to actual needs, which will not be particularly limited herein.

In some examples, concerning the limit of the electric current of the compressor 1, there are different frequency-limiting current values in different temperature intervals of T4.

For example, in the cooling mode of the window air conditioner, a temperature interval where the electric current of the compressor 1 limits the frequency keeps consistent with a frequency limiting interval of the outdoor ambient temperature T4. As shown in Table 1, when T4>TCL5, the frequency limiting current value of the compressor 1 is CoolCurrLimt5; when TCL5≥T4>TCL4, the frequency limiting current value of the compressor 1 is CoolCurrLimt4; when TCL4≥T4>TCL3, the frequency limiting current value of the compressor 1 is CoolCurrLimt3; when TCL3≥T4>TCL2, the frequency limiting current value of the compressor 1 is CoolCurrLimt2; when TCL2≥T4, the frequency limiting current value of the compressor 1 is CoolCurrLimt1; when the compressor 1 is shut down for protection, the frequency limiting current value of the compressor 1 is CoolStopCurr, wherein TCL5>TCL4>TCL3>TCL2. Thus, it is advantageous in further improving the operational reliability of the window air conditioner 100.

TABLE 1

| | |
|---|---|
| CoolCurrLimt5 | T4 > TCL5 |
| CoolCurrLimt4 | TCL5 ≥ T4 > TCL4 |
| CoolCurrLimt3 | TCL4 ≥ T4 > TCL3 |
| CoolCurrLimt2 | TCL3 ≥ T4 > TCL2 |
| CoolCurrLimt1 | TCL2 > T4 |
| Cool StopCurr | Cooling shutdown protection current |

For example, in the heating mode of the window air conditioner, a temperature interval where the electric current of the compressor 1 limits the frequency keeps consistent with a frequency limiting interval of the outdoor ambient temperature T4. As shown in Table 2, when T4≥THL4, the frequency limiting current value of the compressor 1 is HeatCurrLimt4; when THL4>T4≥THL3, the frequency limiting current value of the compressor 1 is HeatCurrLimt3; when THL3>T4≥THL2, the frequency limiting current value of the compressor 1 is HeatCurrLimt2; when THL1>T4≥THL0, the frequency limiting current value of the compressor 1 is HeatCurrLimt1; when THL5≥T4, the frequency limiting current value of the compressor 1 is HeatCurrLimt5; when the compressor 1 is stopped, the frequency limiting current value of the compressor 1 is HeatStopCurr, wherein TCL5>TCL4>TCL3>TCL2. Thus, it is advantageous in further improving the operational reliability of the window air conditioner 100.

TABLE 2

| | |
|---|---|
| HeatCurrLimt4 | T4 ≥ THL4 |
| HeatCurrLimt3 | THL4 > T4 ≥ THL3 |
| HeatCurrLimt2 | THL3 > T4 ≥ THL2 |
| HeatCurrLimt1 | THL1 > T4 ≥ THL0 |
| HeatCurrLimt5 | THL5 > T4 |
| HeatStop Curr | Heating shutdown protection current |

In some examples, as shown in FIG. 1, the outdoor heat exchanger temperature sensor 10*c* is provided at an outlet of the outdoor heat exchanger 2 to measure the temperature T3 of the outdoor heat exchanger 2. Meanwhile, the electronic control device can determine whether the current temperature T3 of the outdoor heat exchanger 2 is continuously rising or continuously dropping, or is slightly changing within a certain defined temperature interval, based on the measurement result of the outdoor heat exchanger temperature sensor 10*c*.

Figure 5:
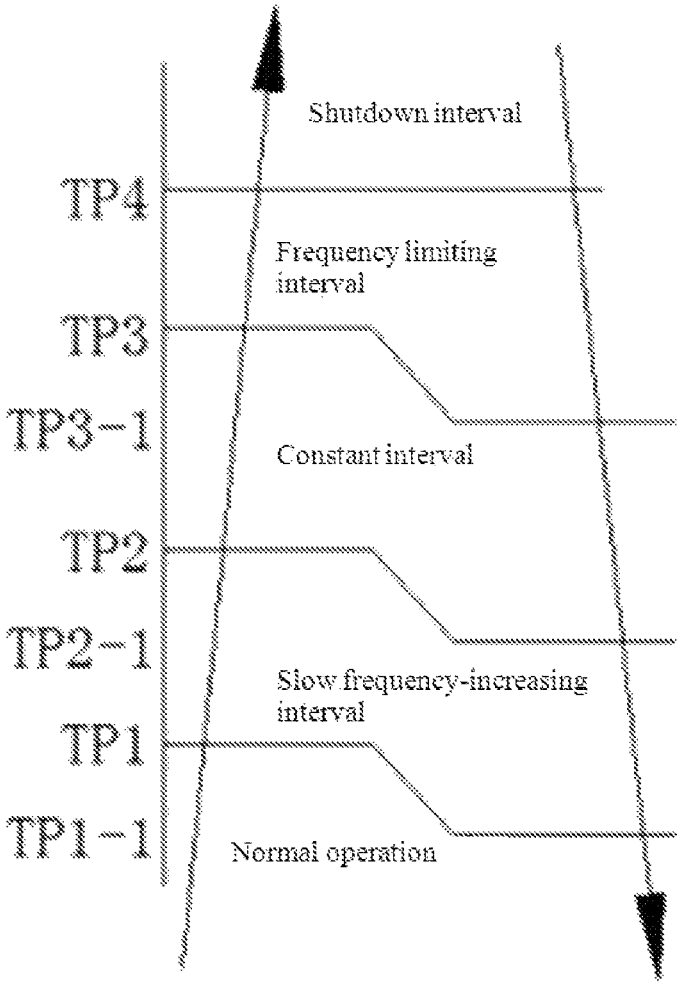
FIG. 5 is a schematic view showing temperature interval division for temperature T3 according to embodiments of the present disclosure.

For example, as shown in FIG. 5, an oblique upward arrow in FIG. 5 indicates the rise of the temperature T3, while an oblique downward arrow in FIG. 5 indicates the drop of the temperature T3. If the electronic control device determines that the temperature T3 rises, an interval where the temperature T3 is greater than TP4 is a shutdown interval of the compressor 1; an interval from TP3 to TP4 is a frequency limiting interval of the compressor 1; an interval from TP2 to TP3 is a constant interval of the compressor 1; an interval from TP1 to TP2 is a slow frequency-increasing interval of the compressor 1; when the temperature T is less than TP1, the compressor 1 operates normally.

If the electronic control device determines that the temperature T3 drops, an interval where a value of the temperature T3 is greater than TP4 is a shutdown interval of the compressor 1; an interval from TP3-1 to TP4 is a frequency limiting interval of the compressor 1; an interval from TP2-1 to TP3-1 is a constant interval of the compressor 1; an interval from TP1-1 to TP2-1 is a slow frequency-increasing interval of the compressor 1; when the temperature T3 is less than TP1-1, the compressor 1 operates normally.

In some examples, as shown in FIG. 5, when the temperature T3 is in the slow frequency-increasing interval, the compressor 1 is controlled to increase the frequency at a speed of TpLimUpSpd_B_ADD; when the temperature T3 is in the constant interval, the compressor 1 is controlled to maintain the current frequency; when the temperature T3 is in the frequency limiting interval, the frequency is immediately limited, and the compressor 1 is controlled to reduce the frequency by T3LimSpd; when the temperature T3 is reduced to be lower than the constant interval, the constancy maintaining is removed, and the compressor 1 is controlled to operate normally; when the temperature T3 is in the shutdown interval and lasts 9 seconds, the compressor 1 is stopped and will not resume the normal operation until the temperature T3 is lower than TP2 and the protection is canceled. Within the above 9 seconds, the frequency of the compressor 1 is reduced according to T3LimSpd. Thus, the third compressor frequency can be obtained according to the temperature T3.

In some embodiments of the present disclosure, when it is determined that the detected temperature T2 of the indoor heat exchanger 4 is lower than a first set temperature, the operating frequency of the compressor 1 is decreased at predetermined time intervals until the temperature T2 is within the fifth temperature interval. Hence, the second compressor frequency can be obtained according to the temperature T2, which is advantageous in ensuring reliable operation of the indoor heat exchanger 4, so as to realize the reliable operation of the window air conditioner 100.

For example, as shown in FIG. 1, the indoor heat exchanger temperature sensor 10*b* is arranged at a semicircular pipe of the indoor heat exchanger 4 to detect the temperature T2 of the indoor heat exchanger 4. The first set temperature is 4° C., and when the temperature T2 of the indoor heat exchanger 4 is lower than 4° C., in order to prevent condensate water on the indoor heat exchanger 4 from freezing, the operating frequency of the compressor 1 is regularly reduced once every 1 minute until the temperature T2 of the indoor heat exchanger is maintained in the fifth temperature interval. If the temperature T2 rises to 7° C. or more, the limitation on the compressor 1 is lifted.

In some examples, when it is detected that the temperature T2≤0° C., the compressor 1 is turned off, and will not restart until the temperature T2 rises to 5° C. or more. Thus, the compressor 1 can be protected, and the reliable operation of the window air conditioner 100 can be ensured.

In some examples, when it is determined that the detected temperature T2 of the indoor heat exchanger 4 is lower than the first set temperature, the frequency of the compressor 1 can be reduced in such a way that the current frequency when the frequency reduction occurs is assumed to be f1, and a target frequency after the frequency reduction has different frequency reduction speeds depending on the magnitude of f1.

For example, when the frequency f1<60 hz, the target frequency after the frequency reduction is f2=0.92*f1; when 60≤f1≤90 hz, the target frequency after the frequency reduction is f2=0.95*f1; when f1>90 hz, the target frequency after the frequency reduction is f2=0.97*f1, wherein the result of the target frequency after the frequency reduction is automatically rounded down. For example, if the calculation result is 19.7, the value of f2 is 19. If the calculated f2 is smaller than a minimum allowable operating frequency of the compressor 1, the compressor operates at the minimum allowable operating frequency, and the frequency is no longer reduced.

In some embodiments of the present disclosure, the indoor heat exchanger temperature sensor 10*a* is disposed near an indoor return air vent of the window air conditioner 100 and the indoor heat exchanger 4, but is not in contact with the indoor heat exchanger 4.

In some embodiments of the present disclosure, a plurality of indoor temperature intervals are preset, and the plurality of indoor temperature intervals correspond to different first compressor frequencies. By determining an indoor temperature interval into which a difference between the detected indoor ambient temperature T1 and the set temperature falls, a corresponding first compressor frequency can be obtained.

It could be understood that the difference between the indoor ambient temperature T1 and the set temperature represents the magnitude of the required refrigeration capacity, and the operating frequency of the compressor 1 can be adjusted according to the magnitude of the temperature difference to meet the user requirement. Therefore, it is advantageous in achieving precise control over the temperature of the indoor environment, and the room temperature fluctuation of the window air conditioner 100 using the inverter compressor 1 is small, such that the window air conditioner using the inverter compressor is more comfortable, compared with the traditional window air conditioner using the fixed speed compressor that controls the room temperature by constant turn-on and turn-off.

Figure 6:
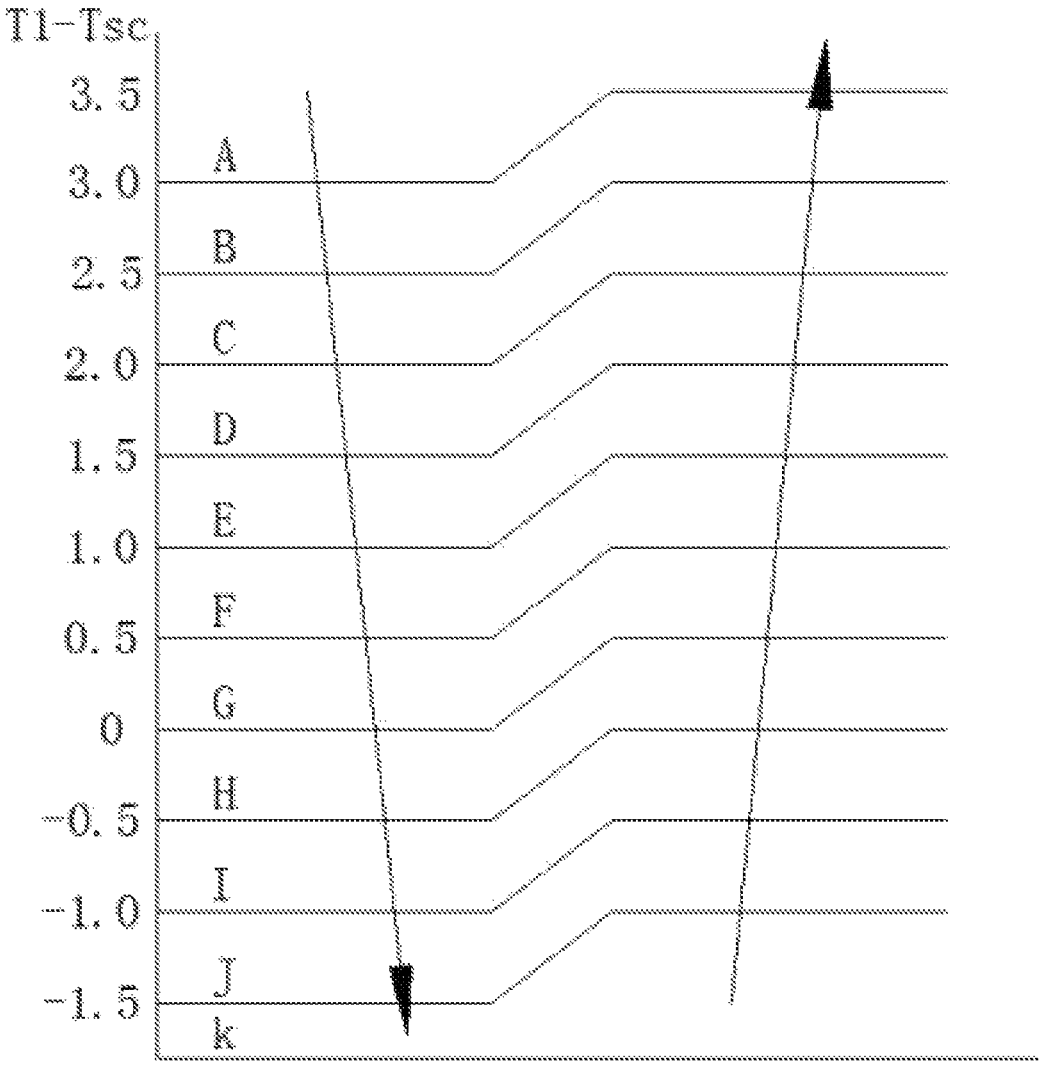
FIG. 6 is a schematic view showing temperature interval division for temperature T1 according to embodiments of the present disclosure.

In some examples, as shown in FIG. 6, the user can set the set temperature of the window air conditioner 100 through a remote controller. For example, the set temperature can be denoted as Tsc, and a temperature range where the difference between T1 and the set temperature covers is divided into N2 temperature intervals. When the difference between T1 and Tsc is large, it means that the room needs greater refrigeration capacity, and at this time, the frequency of operation of the compressor 1 is also higher. With the continuous operation of the compressor 1 and the continuous output of the refrigeration capacity, the difference between T1 and Tsc will become smaller and smaller, and at this time the operating frequency of the compressor 1 will also be reduced, thereby saving energy.

When T1 is very close to Tsc, the compressor 1 is maintained to operate at a very low frequency, and the output of the refrigeration capacity is used to offset the heat leakage of the room. When the indoor load is large, the operating frequency of the compressor 1 is relatively high; when the indoor load is small, the operating frequency is relatively low, thereby achieving precise temperature control. The room temperature fluctuation of the window air conditioner 100 using the inverter compressor 1 is small, such that the window air conditioner using the inverter compressor is more comfortable, compared with the traditional window air conditioner using the fixed speed compressor that controls the room temperature by constant turn-on and turn-off.

In some examples, as shown in FIG. 6, in a case that it is determined that the temperature is continuously decreasing, when T1−Tsc>3.0, the first compressor frequency is frequency A; when 2.5<T1−Tsc<3.0, the first compressor frequency is frequency B; when 2.0<T1−Tsc<2.5, the first compressor frequency is frequency C; when 1.5<T1−Tsc<2.0, the first compressor frequency is frequency D; when 1.0<T1−Tsc<1.5, the first compressor frequency is frequency E; when 0.5<T1−Tsc<1.0, the first compressor frequency is frequency F; when 0<T1−Tsc<0.5, the first compressor frequency is frequency G; when −0.5<T1−Tsc<0, the first compressor frequency is frequency H; when −0.5<T1−Tsc<−1.0, the first compressor frequency is frequency I; when −1.5<T1−Tsc<−1.0, the first compressor frequency is frequency J; when T1−Tsc<−1.5, the first compressor frequency is frequency K. If the current operating frequency is the minimum frequency K, the frequency will not be reduced by a further level when T1−Tsc becomes smaller.

As shown in FIG. 6, in a case that it is determined that the temperature is continuously increasing, when T1−Tsc>3.5, the first compressor frequency is frequency A; when 3.0<T1−Tsc<3.5, the first compressor frequency is frequency B; when 2.5<T1−Tsc<3.0, the first compressor frequency is frequency C; when 2.0<T1−Tsc<2.5, the first compressor frequency is frequency D; when 1.5<T1−Tsc<2.0, the first compressor frequency is frequency E; when 1.0<T1-Tsc<1.5, the first compressor frequency is frequency F; when 0.5<T1−Tsc<1.0, the first compressor frequency is frequency G; when 0<T1−Tsc<0.5, the first compressor frequency is frequency H; when −1.0<T1−Tsc<0.5, the first compressor frequency is frequency I; when −1.5<T1−Tsc<−1.0, the first compressor frequency is frequency J; when T1−Tsc<−1.5, the first compressor frequency is frequency K. If the current operating frequency is the minimum frequency K, the frequency will not be reduced by a further level when T1−Tsc becomes smaller.

In some embodiments of the present disclosure, the sixth compressor frequency is obtained according to the wind level of the indoor fan 5, and the first compressor frequency, the second compressor frequency, the third compressor frequency, the fourth compressor frequency, the fifth compressor frequency, and the sixth compressor frequency are compared to acquire the minimum compressor frequency. Therefore, it is advantageous in further preventing the compressor 1 from being shut down due to excessive temperature or excessive electric current, so that the compressor 1 can operate reliably, and the cooling or heating performance of the window air conditioner 100 is ensured, thereby guaranteeing the user comfort experience.

For example, the indoor fan 5 can have an automatic wind level, a strong wind level, a high wind level, a middle wind level, a low wind level, and a mute wind level. When the wind level of the indoor fan 5 is the automatic wind level, the strong wind level, or the high wind level, the frequency of the compressor 1 is not limited. When the indoor fan 5 is set to the middle wind level, a maximum frequency at which the compressor 1 can operate is Fmid, that is, the sixth compressor frequency is Fmid. When the indoor fan 5 is set to the low wind level, a frequency at which the compressor 1 can operate is Fmin, that is, the sixth compressor frequency is Fmin. When the indoor fan 5 is set to the mute wind level, a maximum frequency at which the compressor 1 can operate is Fone, that is, the sixth compressor frequency is Fone. Hence, the sixth compressor frequency can be obtained according to the wind level of the indoor fan 5, which is advantageous in further ensuring the operational reliability of the window air conditioner 100, and improving the user comfort.

It could be understood that the actual operating frequency of the compressor is determined by the first compressor frequency, the second compressor frequency, the third compressor frequency, the fourth compressor frequency, the fifth compressor frequency, and the sixth compressor frequency, and the minimum compressor frequency among the first compressor frequency, the second compressor frequency, the third compressor frequency, the fourth compressor frequency, the fifth compressor frequency, and the sixth compressor frequency is taken as the actual operating frequency of the compressor.

In some embodiments of the present disclosure, when one of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* is faulty, the faulty sensor is controlled to obtain a corresponding compressor frequency according to corresponding setting conditions. Thus, when one of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* is faulty, the window air conditioner 100 can continue to operate, which can reduce the maintenance frequency of the window air conditioner 100, improve the user experience, and enhance the market competitiveness of the window air conditioner 100.

In some examples, whether the exhaust gas temperature sensor 10*e* is normal or not can be determined in such a manner that when the compressor 1 stops operating, it will not be judged whether the exhaust gas temperature sensor 10*e* has an open-circuit fault. For example, during the operation of the compressor 1, when an A/D value of the exhaust gas temperature sensor 10*e* is smaller than or equal to 2 or is greater than or equal to 254, and the situation lasts for 1 minute, a fault is reported and a fault code is displayed; when the A/D value of the exhaust gas temperature sensor 10*e* is greater than 2 and smaller than 253, the fault is eliminated.

The A/D mentioned above refers to analog-to-digital conversion, that is, a conversion from an analog signal to a digital signal. Before a signal is input to an A/D converter for the A/D conversion, a physical quantity is converted into an electrical signal by the corresponding sensor. For example, a control circuit board of the window air conditioner 100 has a control chip having five pins, and the five pins are electrically connected with respective first ends of the indoor ambient temperature sensor 10*a*, the indoor heat exchanger temperature sensor 10*b*, the outdoor heat exchanger temperature sensor 10*c*, the outdoor ambient temperature sensor

10*d*, and the exhaust gas temperature sensor 10*e*; respective second ends of the indoor ambient temperature sensor 10*a*, the indoor heat exchanger temperature sensor 10*b*, and the outdoor heat exchanger temperature sensor 10*c*, the outdoor ambient temperature sensor 10*d*, and the exhaust gas temperature sensor 10*e* are connected to a 5V power source. It could be understood that when a temperature sensor senses a temperature change, a resistance value of the temperature sensor changes, and a corresponding voltage will vary along with the change of the resistance value, so that it can be judged whether the temperature sensor is normal or not.

In some examples, whether the indoor ambient temperature sensor 10*a*, the indoor heat exchanger temperature sensor 10*b*, the outdoor heat exchanger temperature sensor 10*c*, and the outdoor ambient temperature sensor 10*d* are normal or not can be determined in such a manner that when AD sampling voltages corresponding to the indoor ambient temperature sensor 10*a*, the indoor heat exchanger temperature sensor 10*b*, the outdoor heat exchanger temperature sensor 10*c*, and the outdoor ambient temperature sensor 10*d* are smaller than 0.06V or greater than 4.94V, the temperature sensors are considered to malfunction, and different fault codes are respectively displayed.

In some embodiments of the present disclosure, when at least two of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* are faulty, the window air conditioner 100 is controlled to stop operating. The term "at least two" means two or more than two. Thus, it can be ensured that the window air conditioner 100 operates in a safe state, thereby reducing safety risks. For example, when at least two of the indoor ambient temperature sensor 10*a*, the indoor heat exchanger temperature sensor 10*b*, the outdoor heat exchanger temperature sensor 10*c*, the outdoor ambient temperature sensor 10*d*, and the exhaust gas temperature sensor 10*e* are faulty, the window air conditioner 100 is controlled to stop operating, and a fault code is displayed.

In some embodiments of the present disclosure, when the indoor ambient temperature sensor 10*a* is faulty, the indoor ambient temperature T1 detected by the indoor ambient temperature sensor 10*a* is set to 26° C. Thereby, the control is simple, and it is advantageous in reducing the control cost. For example, in the cooling, dehumidification, or heating mode of the window air conditioner 100, when the indoor ambient temperature sensor 10*a* is faulty, the indoor ambient temperature T1 detected by the indoor ambient temperature sensor 10*a* is set to 26° C., the corresponding first compressor frequency can be obtained, according to FIG. 4 and the set temperature Tsc of the window air conditioner 100 set by the user.

In some embodiments of the present disclosure, a first temperature interval, a second temperature interval, a third temperature interval, and a fourth temperature interval are set. When the indoor heat exchanger temperature sensor 10*b* is faulty, referring to FIG. 7, during the refrigeration, if it is detected that the indoor ambient temperature T1 is in the first temperature interval, the second compressor frequency is a first set value, and if it is detected that the indoor ambient temperature T1 is in the second temperature interval, the second compressor frequency is a second set value, wherein temperatures of the first temperature interval are lower than those of the second temperature interval; referring to FIG. 8, during the heating, if the detected indoor ambient temperature T1 is in the third temperature interval, the second compressor frequency is the second set value, and if the detected indoor ambient temperature T1 is in the fourth temperature interval, the second compressor frequency is the first set value, wherein temperatures of the third temperature interval are lower than those of the fourth temperature interval. Therefore, when the indoor heat exchanger temperature sensor 10*b* is faulty, the reliable operation of the window air conditioner 100 can be ensured, which is advantageous in saving maintenance costs.

In some examples, in the cooling or dehumidification mode of the window air conditioner 100, when the indoor ambient temperature sensor 10*a* is faulty, the indoor ambient temperature sensor T1 detected by the indoor ambient temperature sensor 10*a* is set to 26° C.

Figure 7:
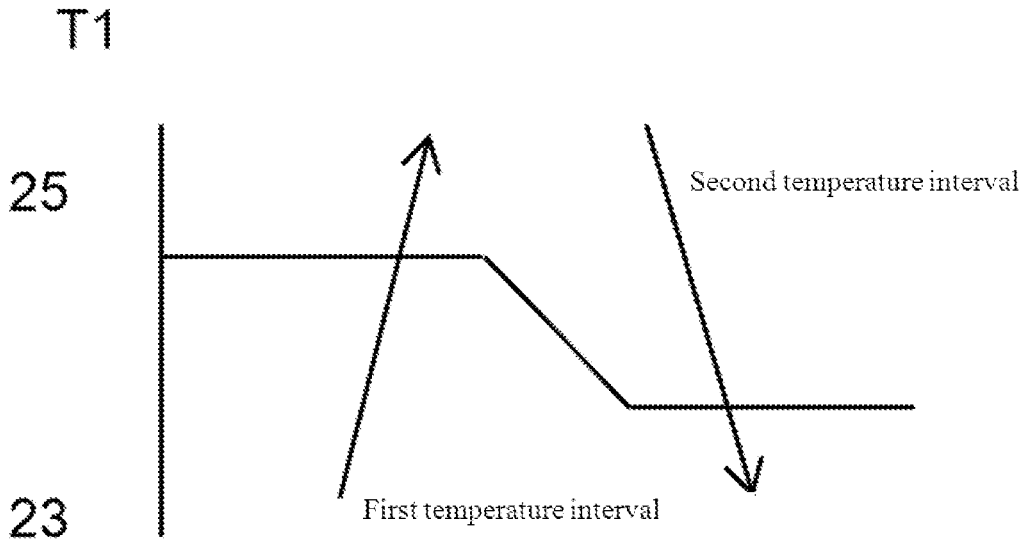
FIG. 7 is a schematic view showing temperature interval division for temperature T1 when a temperature sensor of an indoor heat exchanger according to embodiments of the present disclosure malfunctions, in which a window air conditioner is in a cooling mode or a dehumidification mode.
Figure 8:
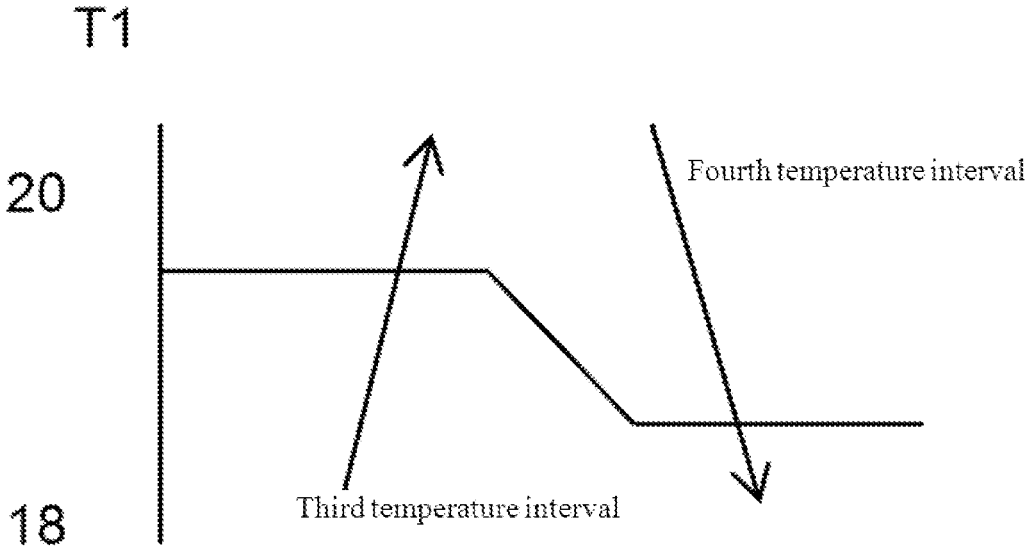
FIG. 8 is a schematic view showing temperature interval division for temperature T1 when a temperature sensor of an indoor heat exchanger according to embodiments of the present disclosure malfunctions, in which a window air conditioner is in a heating mode.

In a case that the indoor heat exchanger temperature sensor 10*b* is faulty, as shown in FIG. 7, when T1 is rising and T1 satisfies: T1>25° C., the second compressor frequency is F12; when T1 is rising and T1 satisfies: T1<25° C., the second compressor frequency is F4; if it is detected that T1 is dropping and T1 satisfies: T1<23° C., the second compressor frequency is F4; if it is detected that T1 is dropping and T1 satisfies: T1>23° C., the second compressor frequency is F12, wherein both F12 and F4 are set values.

In some examples, the judgment and processing begins with the temperature T1 rising and being in the first temperature interval, and then the compressor 1 is controlled to alternate in 30 minutes of operation and 3 minutes of downtime according to the temperature T1.

When the outdoor heat exchanger temperature sensor 10*c* is faulty, the operating frequency of the compressor 1 is set not to exceed a rated cooling frequency, and other restrictions are valid.

When the outdoor ambient temperature sensor 10*d* is faulty, the operating frequency of the compressor 1 is set not to exceed the rated cooling frequency of the compressor 1, the frequency limits by current and voltage are processed according to an interval T4>50.5° C., the outdoor fan 3 operates in the high wind level, the minimum operating frequency of the compressor 1 limited by high temperature of the temperature T4 is valid, and other restrictions are valid.

When the exhaust gas temperature sensor 10*e* is faulty, the operating frequency of the compressor 1 does not exceed the rated operating frequency of the compressor 1, the frequency limit values limited by current and voltage are processed according to an interval T4>50.5° C., the outdoor fan 3 operates in the high wind level, and other restrictions are valid.

In some examples, in the heating mode of the window air conditioner 100, when the indoor ambient temperature sensor 10*a* is faulty, the indoor ambient temperature T1 detected by the indoor ambient temperature sensor 10*a* is set to 26° C.

In a case that the indoor heat exchanger temperature sensor 10*b* is faulty, when it is detected that T1 is rising and T1 satisfies: T1>20° C., the second compressor frequency is F4; when it is detected that T1 is rising and T1 satisfies: T1<20° C., the second compressor frequency is F12; when it is detected that T1 is rising and T1 satisfies: T1<18° C., the second compressor frequency is F12; when it is detected that T1 is rising and T1 satisfies: T1>18° C., the second compressor frequency is F4.

In some examples, the judgment and processing begins with the temperature T1 rising and being in the third temperature interval, and then the compressor 1 is controlled to alternate in 30 minutes of operation and 3 minutes of downtime according to the temperature T1.

When the outdoor heat exchanger temperature sensor 10*c* is faulty, if T4<7° C., the compressor 1 continuously operates for 30 minutes and is forced to be defrosted once, and the defrosting lasts 5 minutes; if T4≥7° C., the compressor 1 continuously operates for 60 minutes and is forced to be defrosted once, and the defrosting lasts 3 minutes.

When the outdoor ambient temperature sensor 10*d* is faulty, the maximum frequency of the compressor 1 does not exceed F14, the frequency limit values limited by current and voltage are processed according to an interval T4=15° C., and the outdoor fan 3 operates in the high wind level.

When the exhaust gas temperature sensor 10*e* is faulty, the operating frequency of the compressor 1 does not exceed F14, and the outdoor fan 3 operates in the high wind level.

In some embodiments of the present disclosure, the refrigerant used in the window air conditioner 100 is refrigerant R32. Refrigerant R32 has better thermophysical properties and higher heat exchange efficiency than other refrigerants such as R410a, R22, R290 and etc., such that a refrigeration system requires a smaller heat exchange area to achieve the same refrigeration capacity, the refrigerant charge of the refrigeration system can be appropriately reduced, and the comprehensive energy conservation of the refrigeration system can reach more than 5%. For example, when the compressor 1 of the same displacement is used, the refrigeration capacity of the refrigeration system in the present disclosure is about 12% higher than that of the refrigeration system using refrigerant R410a, and the energy efficiency is improved by about 5%.

In addition, refrigerant R32 is a difluoromethane freon refrigerant, which is a refrigerant having a potential of zero ozone depletion, it is gaseous at normal temperature, and it is a colorless transparent liquid under its own pressure, soluble in oil, and insoluble in water. Refrigerant R32 is colorless and odorless, slightly flammable but not explosive, and non-toxic, and it is a safe refrigerant; its GWP is 675, so refrigerant R32 is more environmentally friendly. However, for the window air conditioner using refrigerant R22 in the related art, since the thermodynamic properties of refrigerant R22 is close to those of ammonia, the GWP is up to 1780, which is not conducive to environmental protection; for the window air conditioner 100 using the refrigerant R410a in the related art, since R410a is a near-azeotropic mixed refrigerant, different boiling points result in slight temperature glide, and the GWP is up to 1997, which is not conducive to environmental protection.

Figure 2:
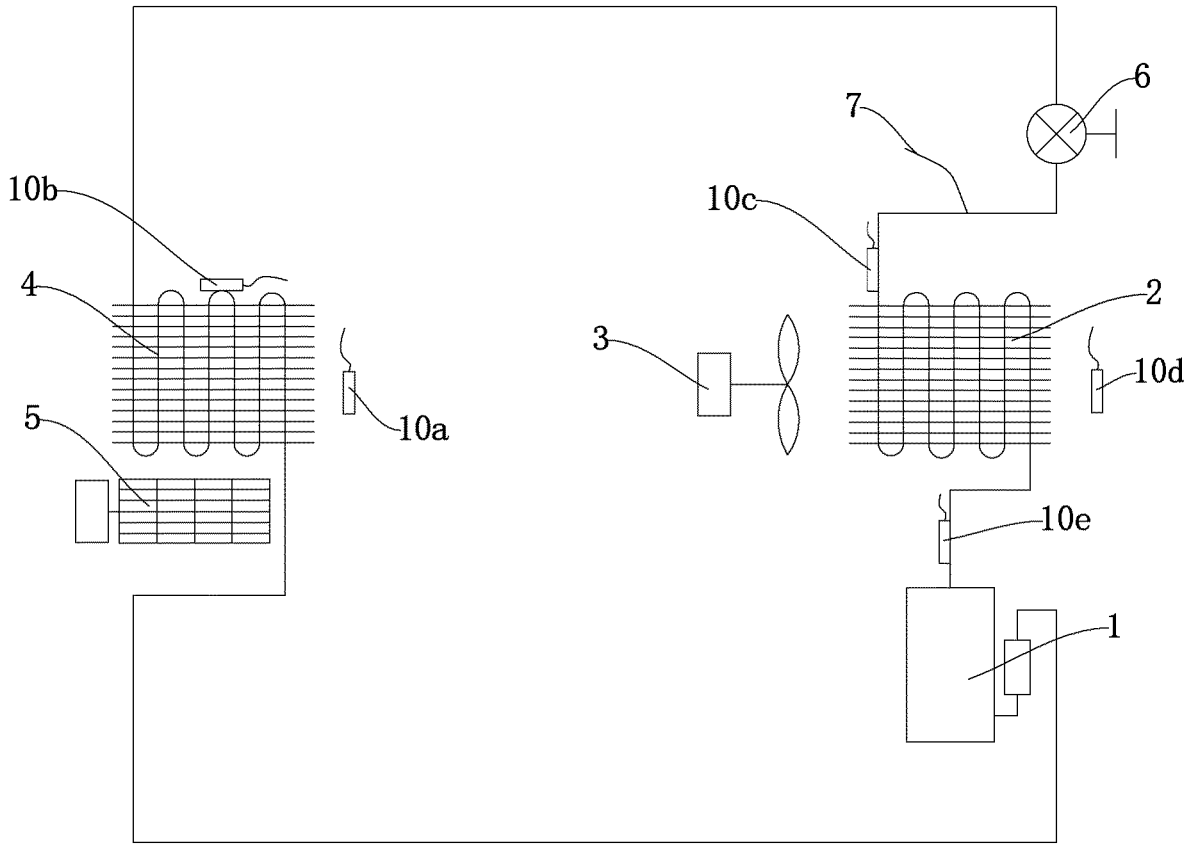
FIG. 2 is a structural schematic view of a window air conditioner according to some other embodiments of the present disclosure.

In some examples, during the production, a processing pipe 7 is used for refrigerant charging. For example, as shown in FIG. 2, a pipe orifice of the processing pipe 7 is ultrasonically welded or sealed by LOKRING, and the processing pipe 7 is in communication with a connecting pipe between the outdoor heat exchanger 2 and the throttling device 6. Therefore, a risk of flame welding is avoided. After the refrigerant is packaged, it is necessary to detect package leakage once, such that the overall cost is relatively low and the efficiency is high. Although the refrigerant R32 used has a slight burning level, it is not explosive or toxic, and hence it is still a safe refrigerant. In addition, the window air conditioner 100 is an all-in-one machine, and neither needs to be disassembled during household installation nor involves on-site pipeline installation. Therefore, it is not necessary to perform safety inspection after the household installation, and a pre-delivery inspection suffices, thereby reducing the installation costs.

Other configurations and operations of the window air conditioner 100 according to embodiments of the present disclosure are known to those skilled in the art and will not described herein.

In the specification, it is to be understood that terms such as "central," "length," "width," "thickness," "upper," "lower," "front," "rear," "left," "right," "vertical," "horizontal," "top," "bottom," "inner," "outer," "axial," "radial," and "circumferential" should be construed to refer to the orientation as then described or as shown in the drawings under discussion. These relative terms are for convenience of description and do not indicate or imply that the device or element referred to must have a particular orientation, or be constructed and operated in a particular orientation. Thus, these terms shall not be construed to limit the present disclosure.

In addition, terms such as "first" and "second" are used herein for purposes of description and are not intended to indicate or imply relative importance or significance. Thus, the feature defined with "first" and "second" may comprise one or more this feature. In the description of the present disclosure, the term "a plurality of" means two or more than two, unless specified otherwise.

In the present disclosure, unless specified or limited otherwise, it should be understood that the terms "mounted," "connected," "coupled," "fixed" and the like are used broadly, and may be, for example, fixed connections, detachable connections, or integral connections; may also be mechanical or electrical connections; may also communicate with each other; may also be direct connections or indirect connections via intervening structures; may also be inner communications or mutual interaction of two elements, which could be understood by those skilled in the art according to specific situations.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples. In addition, different embodiments or examples as well as features in different embodiments or examples described herein can be combined without any contradiction.

Although embodiments of the present disclosure have been shown and described, it would be appreciated by those skilled in the art that changes, modifications, alternatives and variations can be made in the embodiments without departing from the scope of the present disclosure. The scope of the invention is defined by the claims and the like.

What is claimed is:

1. A method for controlling an air conditioner comprising:

after the air conditioner is turned on, controlling an indoor ambient temperature sensor to determine an indoor ambient temperature, controlling an indoor heat exchanger temperature sensor to determine an indoor heat exchanger temperature, controlling an outdoor heat exchanger temperature sensor to determine an outdoor heat exchanger temperature, controlling an outdoor ambient temperature sensor to determine an outdoor ambient temperature, and controlling an exhaust gas temperature sensor to determine an exhaust gas temperature;

determining a first compressor frequency based on the indoor ambient temperature, determining a second compressor frequency based on the indoor heat exchanger temperature, determining a third compressor frequency based on the outdoor heat exchanger temperature, determining a fourth compressor frequency based on the outdoor ambient temperature, and determining a fifth compressor frequency based on the exhaust gas temperature;

determining a minimum compressor frequency based on the first compressor frequency, the second compressor frequency, the third compressor frequency, the fourth compressor frequency, and the fifth compressor frequency; and controlling a compressor of the air conditioner to operate at the minimum compressor frequency.

2. The method according to claim 1, wherein:

controlling the indoor ambient temperature sensor to determine the indoor ambient temperature includes, in response to the indoor ambient temperature sensor being faulty, controlling the indoor ambient temperature sensor to determine the indoor ambient temperature according to a setting condition corresponding to the indoor ambient temperature sensor;

controlling the indoor heat exchanger temperature sensor to determine the indoor heat exchanger temperature includes, in response to the indoor heat exchanger temperature sensor being faulty, controlling the indoor heat exchanger temperature sensor to determine the indoor heat exchanger temperature according to a setting condition corresponding to the indoor heat exchanger temperature sensor;

controlling the outdoor heat exchanger temperature sensor to determine the outdoor heat exchanger temperature includes, in response to the outdoor heat exchanger temperature sensor being faulty, controlling the outdoor heat exchanger temperature sensor to determine the outdoor heat exchanger temperature according to a setting condition corresponding to the outdoor heat exchanger temperature sensor;

controlling the outdoor ambient temperature sensor to determine the outdoor ambient temperature includes, in response to the outdoor ambient temperature sensor being faulty, controlling the outdoor ambient temperature sensor to determine the outdoor ambient temperature according to a setting condition corresponding to the outdoor ambient temperature sensor; or controlling the exhaust gas temperature sensor to determine the exhaust gas temperature includes, in response to the exhaust gas temperature sensor being faulty, controlling the exhaust gas temperature sensor to determine the exhaust gas temperature according to a setting condition corresponding to the exhaust gas temperature sensor.

3. The method according to claim 1, further comprising:

controlling the air conditioner to stop operating in response to two or more of the indoor ambient temperature sensor, the indoor heat exchanger temperature sensor, the outdoor heat exchanger temperature sensor, the outdoor ambient temperature sensor, and the exhaust gas temperature sensor being faulty.

4. The method according to claim 1, wherein controlling the indoor ambient temperature sensor to determine the indoor ambient temperature includes, in response to the indoor ambient temperature sensor being faulty, controlling the indoor ambient temperature sensor to determine the indoor ambient temperature to be 26° C.

5. The method according to claim 1, wherein determining the second compressor frequency includes, in response to the indoor heat exchanger temperature sensor being faulty:

during refrigeration:

in response to the indoor ambient temperature being in a first temperature interval, determining the second compressor frequency to have a first set value; or in response to the indoor ambient temperature being in a second temperature interval higher than the first temperature interval, determining the second compressor frequency to have a second set value; or during heating:

in response to the indoor ambient temperature being in a third temperature interval, determining the second compressor frequency to have the second set value; or in response to the indoor ambient temperature being in a fourth temperature interval higher than the third temperature interval, determining the second compressor frequency to have the first set value.

6. The method according to claim 1, wherein determining the first compressor frequency includes determining the first compressor frequency based on a difference between the indoor ambient temperature and a set temperature.

7. The method according to claim 1, further comprising:

in response to the indoor heat exchanger temperature being lower than a set temperature, reducing an operating frequency of the compressor at predetermined time intervals, until the indoor heat exchanger temperature falls in a predetermined temperature interval.

8. The method according to claim 1, further comprising:

turning off the compressor in response to detecting that the indoor heat exchanger temperature equals to or is smaller than 0° C.

9. The method according to claim 1, further comprising:

in response to detecting that the outdoor heat exchanger temperature is greater than a first preset temperature, controlling an outdoor fan of the air conditioner to turn on; or in response to detecting that the outdoor heat exchanger temperature is lower than a second preset temperature lower than the first preset temperature, controlling the outdoor fan to turn off.

10. The method according to claim 1, wherein a refrigerant used in the air conditioner is refrigerant R32.

11. The method according to claim 1, further comprising:

determining a sixth compressor frequency according to a wind level of an indoor fan of the air conditioner; and determining the minimum compressor frequency includes determining the minimum compressor frequency based on the first compressor frequency, the second compressor frequency, the third compressor frequency, the fourth compressor frequency, the fifth compressor frequency, and the sixth compressor frequency.

12. An air conditioner comprising:

a compressor;

an outdoor heat exchanger;

an indoor heat exchanger;

an indoor ambient temperature sensor configured to detect an indoor ambient temperature;

an indoor heat exchanger temperature sensor configured to detect an indoor heat exchanger temperature of the indoor heat exchanger;

an outdoor heat exchanger temperature sensor configured to detect an outdoor heat exchanger temperature of the outdoor heat exchanger;

an outdoor ambient temperature sensor configured to detect an outdoor ambient temperature;

an exhaust gas temperature sensor configured to detect an exhaust gas temperature; and an electronic controller configured to:

control the air conditioner to turn on;

control the indoor ambient temperature sensor to determine the indoor ambient temperature, control the indoor heat exchanger temperature sensor to determine the indoor heat exchanger temperature, control the outdoor heat exchanger temperature sensor to determine the outdoor heat exchanger temperature, control the outdoor ambient temperature sensor to determine the outdoor ambient temperature, and control the exhaust gas temperature sensor to determine the exhaust gas temperature;

determine a first compressor frequency based on the indoor ambient temperature, determine a second compressor frequency based on the indoor heat exchanger temperature, determine a third compressor frequency based on the outdoor heat exchanger temperature, determine a fourth compressor frequency based on the outdoor ambient temperature, and determine a fifth compressor frequency based on the exhaust gas temperature;

determine a minimum compressor frequency based on the first compressor frequency, the second compressor frequency, the third compressor frequency, the fourth compressor frequency, and the fifth compressor frequency; and control the compressor to operate at the minimum compressor frequency.

13. The air conditioner according to claim 12, wherein the electronic controller is further configured to:

control the indoor ambient temperature sensor to determine the indoor ambient temperature by, in response to the indoor ambient temperature sensor being faulty, controlling the indoor ambient temperature sensor to determine the indoor ambient temperature according to a setting condition corresponding to the indoor ambient temperature sensor;

control the indoor heat exchanger temperature sensor to determine the indoor heat exchanger temperature by, in response to the indoor heat exchanger temperature sensor being faulty, controlling the indoor heat exchanger temperature sensor to determine the indoor heat exchanger temperature according to a setting condition corresponding to the indoor heat exchanger temperature sensor;

control the outdoor heat exchanger temperature sensor to determine the outdoor heat exchanger temperature by, in response to the outdoor heat exchanger temperature sensor being faulty, controlling the outdoor heat exchanger temperature sensor to determine the outdoor heat exchanger temperature according to a setting condition corresponding to the outdoor heat exchanger temperature sensor;

control the outdoor ambient temperature sensor to determine the outdoor ambient temperature by, in response to the outdoor ambient temperature sensor being faulty, controlling the outdoor ambient temperature sensor to determine the outdoor ambient temperature according to a setting condition corresponding to the outdoor ambient temperature sensor; or control the exhaust gas temperature sensor to determine the exhaust gas temperature by, in response to the exhaust gas temperature sensor being faulty, controlling the exhaust gas temperature sensor to determine the exhaust gas temperature according to a setting condition corresponding to the exhaust gas temperature sensor.

14. The air conditioner according to claim 12, wherein the electronic controller is further configured to:

control the air conditioner to stop operating in response to two or more of the indoor ambient temperature sensor, the indoor heat exchanger temperature sensor, the outdoor heat exchanger temperature sensor, the outdoor ambient temperature sensor, and the exhaust gas temperature sensor being faulty.

15. The air conditioner according to claim 12, wherein the electronic controller is further configured to control the indoor ambient temperature sensor to determine the indoor ambient temperature by, in response to the indoor ambient temperature sensor being faulty, controlling the indoor ambient temperature sensor to determine the indoor ambient temperature to be 26° C.

16. The air conditioner according to claim 12, wherein the electronic controller is further configured to determine the second compressor frequency by, in response to the indoor heat exchanger temperature sensor being faulty:

during refrigeration:

in response to the indoor ambient temperature being in a first temperature interval, determining the second compressor frequency to have a first set value; or in response to the indoor ambient temperature being in a second temperature interval higher than the first temperature interval, determining the second compressor frequency to have a second set value; or during heating:

in response to the indoor ambient temperature being in a third temperature interval, determining the second compressor frequency to have the second set value; or in response to the indoor ambient temperature being in a fourth temperature interval higher than the third temperature interval, determining the second compressor frequency to have the first set value.

17. The air conditioner according to claim 12, wherein the electronic controller is further configured to determine the first compressor frequency by determining the first compressor frequency based on a difference between the indoor ambient temperature and a set temperature.

18. The air conditioner according to claim 12, wherein the electronic controller is further configured to:

in response to the indoor heat exchanger temperature being lower than a set temperature, reduce an operating frequency of the compressor at predetermined time intervals, until the indoor heat exchanger temperature falls in a predetermined temperature interval.

19. The air conditioner according to claim 12, wherein the electronic controller is further configured to:

turn off the compressor in response to detecting that the indoor heat exchanger temperature equals to or is smaller than 0° C.

20. The air conditioner according to claim 12, further comprising:

an outdoor fan;

wherein the electronic controller is further configured to in response to detecting that the outdoor heat exchanger temperature is greater than a first preset temperature, control the outdoor fan to turn on; or in response to detecting that the outdoor heat exchanger temperature is lower than a second preset temperature lower than the first preset temperature, control the outdoor fan to turn off.

* * * * *